US007258341B2

(12) United States Patent
Pirouzkhah et al.

(10) Patent No.: US 7,258,341 B2
(45) Date of Patent: Aug. 21, 2007

(54) VARIABLE POINT GENERATION CRAPS GAME

(75) Inventors: Alireza Pirouzkhah, 9150 Florence Ave., #200, Downey, CA (US) 90240; Susan L. Melendez, 846 N. Keenan St., Montebello, CA (US) 90640

(73) Assignees: Alireza Pirouzkhah, Downey, CA (US); Susan L. Melendez, Montebello, CA (US)

( * ) Notice: Subject to any disclaimer, the term of this patent is extended or adjusted under 35 U.S.C. 154(b) by 0 days.

(21) Appl. No.: 10/691,138

(22) Filed: Oct. 21, 2003

(65) Prior Publication Data

US 2005/0082749 A1 Apr. 21, 2005

(51) Int. Cl.
*A63B 71/00* (2006.01)

(52) U.S. Cl. ..... 273/139; 273/309; 273/146; 273/274

(58) Field of Classification Search ..... 273/139
See application file for complete search history.

(56) References Cited

U.S. PATENT DOCUMENTS

| | | | | | |
|---|---|---|---|---|---|
| 3,910,581 | A | | 10/1975 | Nicholson | |
| 4,480,838 | A | | 11/1984 | Aharonian | |
| 4,688,803 | A | * | 8/1987 | Ollington | 273/274 |
| 4,743,031 | A | * | 5/1988 | Lamle | 273/146 |
| 4,746,126 | A | * | 5/1988 | Angileri | 273/249 |
| 4,902,019 | A | * | 2/1990 | Berman | 273/256 |
| 5,018,744 | A | | 5/1991 | Patracuolia | |
| 5,513,850 | A | * | 5/1996 | Vancura | 273/274 |
| 5,542,671 | A | * | 8/1996 | Stewart | 273/146 |
| 5,607,161 | A | | 3/1997 | Skratulia | |
| 5,620,183 | A | * | 4/1997 | Skratulia | 273/146 |
| 5,649,704 | A | * | 7/1997 | Dobbin | 273/268 |
| 5,676,375 | A | | 10/1997 | Pirouzkhah | |
| 5,690,337 | A | | 11/1997 | Somma et al. | |
| 5,692,748 | A | | 12/1997 | Frisco et al. | |
| 5,732,948 | A | | 3/1998 | Yoseloff | |
| 5,806,847 | A | * | 9/1998 | White et al. | 273/309 |
| 5,924,926 | A | * | 7/1999 | Brown | 463/11 |
| 5,931,471 | A | * | 8/1999 | Bonito | 273/274 |
| 5,957,452 | A | | 9/1999 | Patton | |
| 5,964,463 | A | * | 10/1999 | Moore, Jr. | 273/274 |
| 5,997,000 | A | * | 12/1999 | Nakano et al. | 273/274 |
| 6,070,872 | A | | 6/2000 | Squitieri | |
| 6,123,335 | A | | 9/2000 | Adkins | |

(Continued)

*Primary Examiner*—Eugene Kim
*Assistant Examiner*—Dolores R. Collins
(74) *Attorney, Agent, or Firm*—Alireza Pirouzkhah; Susan L. Melendez

(57) ABSTRACT

A variable point generation craps game includes a random indicator generator providing only members of a predetermined set of indicators, at least two point value selectors and a bet. Each of the indicators designates a point value selector, each of which has an initial state providing all possible point values obtainable, and with the same probability, from a single roll of a standard pair of dice. The point value selectors yield at least one point for the craps game upon designation by the random indicator generator. The bet depends upon at least one point value selected by at least one of the point value selectors. In a variation, a single point value selector is used and the random indicator generator designates an integer that determines a predetermined operation to be performed upon the point value selector to yield at least one point for the craps game.

7 Claims, 3 Drawing Sheets

U.S. PATENT DOCUMENTS 6,273,423 B1 * 8/2001 Promutico ..... 273/274
6,299,167 B1 10/2001 Sines et al.
6,302,395 B1 10/2001 Astaneha
6,508,469 B2 * 1/2003 Promutico ..... 273/274
6,761,353 B2 * 7/2004 Berman et al. ..... 273/146
6,802,508 B2 * 10/2004 Moody ..... 273/146
2004/0173966 A1 * 9/2004 Stasi ..... 273/274
2005/0001379 A1 * 1/2005 Moore, Jr. ..... 273/292

* cited by examiner

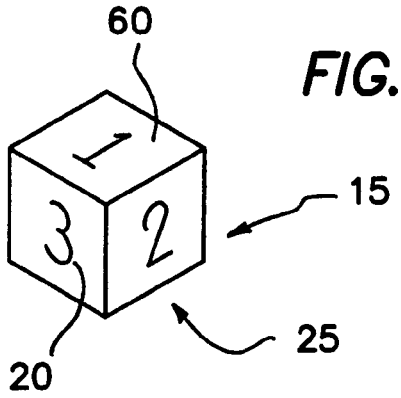
FIG. 1
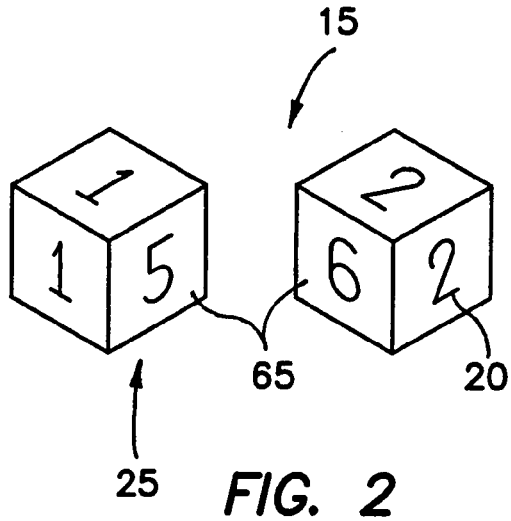
FIG. 2
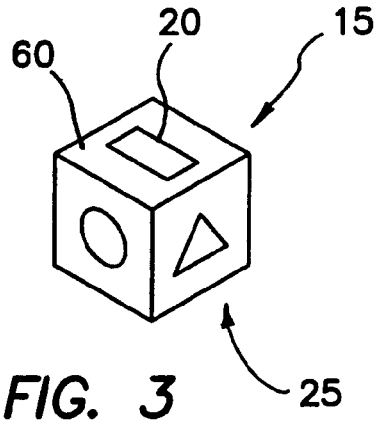
FIG. 3
FIG. 4
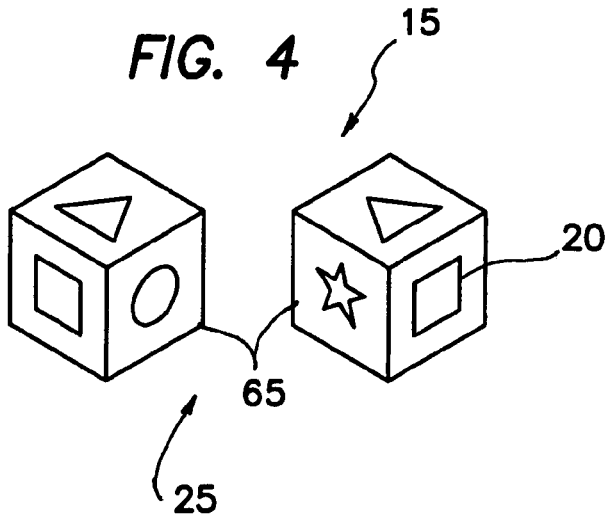

FIG. 5
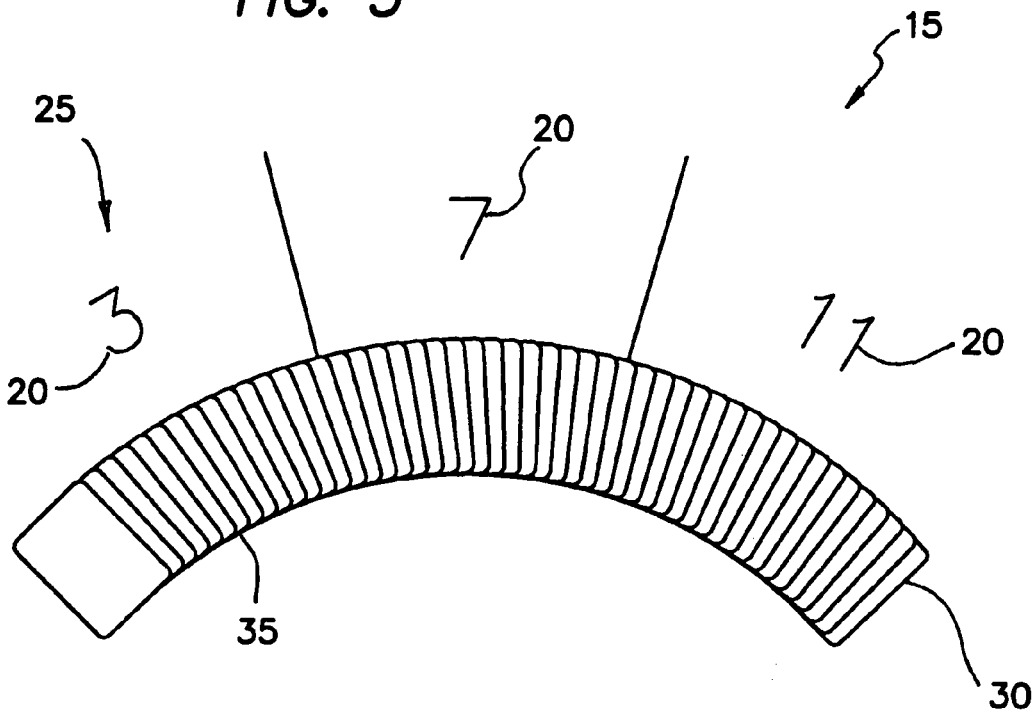
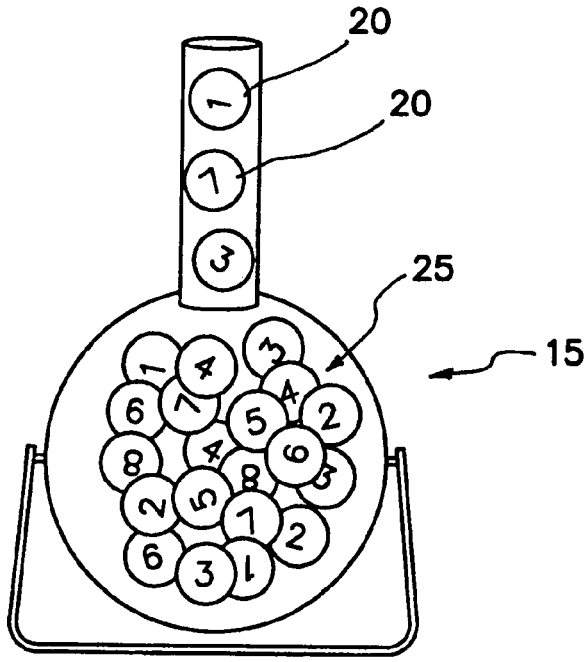
FIG. 6

VARIABLE POINT GENERATION CRAPS GAME

FIELD OF INVENTION

The invention pertains to games of chance. More particularly, the invention relates to a variation on a dice game known as craps, however, involving a variable means of generating target and subsequent game points.

BACKGROUND OF THE INVENTION

Many variations of the dice game known as craps have been developed, each attempting to add some novel feature designed to interest the gambling public. U.S. patent application Publication Ser. No. 2003/0032471, for Darder is directed to an apparatus for simulating games of chance with cards. In simulating a craps game, cards are used in place of dice. The cards can be special, in that all possible variations of dice outcomes are represented. Wilde cards, such as jokers, can also be included. Multiple sets of cards along with multiple shufflers can also be used.

U.S. Pat. No. 5,607,161 issued to Skratulia, discloses a method of playing an improved version of the game of pai gow poker. Here a set of three special dice are provided which include representation of the numbers 0, 1, 2 and 4 such that when rolled, the total numeric value of the three dice would be one of the numbers 1 through 8, with each number being equally probable. Further, a revised 56-card playing deck is provided, including a 52-card standard deck plus four jokers.

U.S. Pat. No. 4,480,838, issued to Aharonian discloses a family financial board game. Here the game apparatus includes a pair of special dice where one die has an X on three of its faces and is blank on the other three faces, and the other die has an X on two of its faces, a Y on another two of its faces, and the remaining two faces are blank. Each would yield a combination of an X and a Y, an X and an X, and the casting of a blank provides a third outcome.

U.S. Pat. No. 6,302,395 issued to Astaneha is directed to a combination dice, card and roulette gambling game. In the gambling game that includes a throw of special dice, each die has a plurality of faces with a color and number on it. A plurality of cards is provided, each card having a number and a color on it. A rotatable wheel is provided that has indications for segmented areas thereon to allow a variety of creative gambling games to be played.

U.S. Pat. No. 5,690,337 issued to Somma et al. is directed to a betting game apparatus and method of play. The casino card game utilizes a single 41-card deck of playing cards consisting of a standard four suit playing card deck from which all face cards have been removed and a single joker card has been added.

While other variations exist, the above-described variations of card and dice games are typical of those encountered in the prior art. It is an objective of the present invention to provide a variation of a traditional dice crap game by utilizing special card decks designed to provide the numerical combinations available in a standard pair of dice. It is a further objective to provide such combinations in multiple decks of cards. It is a still further objective of the invention to provide a means to randomly select the deck of cards from which a card will be drawn to indicate a "point" for a craps game. It is yet a further objective to provide for the instantaneous reshuffling of a card deck after a card has been drawn and returned to the deck from which it was drawn to maintain the odds of drawing any particular point. It is also an objective to provide a means for playing a craps game utilizing a single special card deck and counting down through that deck to a card to be used as a point for the game based upon a number generated by a pair of dice or other random integer generator. Finally, it is an objective to provide a craps-type game in which the odds of drawing any particular point may change with the removal of cards from the decks.

While some of the objectives of the present invention are disclosed in the prior art, none of the inventions found include all of the requirements identified.

SUMMARY OF THE INVENTION

The present invention addresses all of the deficiencies of prior art craps game inventions and satisfies all of the objectives described above.

(1) A variable point generation craps game may be constructed from the following components. A random indicator generator is provided. The random indicator generator is capable of generating only members of a predetermined set of indicators. At least two point value selectors are provided. Each of the set of predetermined indicators designates one of the at least two point value selectors. Each of the point value selectors has an initial state providing all possible point values obtainable from a single roll of a standard pair of dice. The point values are available from the point value selector with the same probability as from the standard pair of dice. Each of the point value selectors yields at least one point for the craps game upon designation by the random indicator generator. A bet is made. The bet depends upon at least one point value selected by at least one of the point value selectors.

(2) In a variant of the invention, a random indicator generator is provided. The random indicator generator is capable of generating only members of a predetermined set of indicators. At least one point value selector is provided. Each of the set of predetermined indicators designates a predetermined operation of at least one of the point value selectors. Each of the point value selectors has an initial state providing all possible point values obtainable from a single roll of a standard pair of dice. The point values are available from the point value selector with the same probability as from the standard pair of dice. The predetermined operation of each of the point value selectors yields at least one point for the craps game upon designation by the random indicator generator. A bet is made. The bet depends upon at least one point value selected by at least one of the point value selectors.

(3) In another variant, the random indicator generator further comprises at least one special die.

(4) In still another variant, the random indicator generator further comprises a special pair of dice.

(5) In yet another variant of the invention, the point value selector further comprises a special deck of cards. Each of the cards has an assigned point value. A top card of the special deck is drawn to yield a point for the craps game upon designation of the special deck of cards by the random indicator generator.

(6) In yet a further variant, the point value selector further comprises a special deck of cards. Each of the cards has an assigned point value. A card of the special deck is drawn based upon the predetermined operation to yield a point for the craps game upon designation of the predetermined operation by the random indicator generator.

(7) In another variant of the invention, the special deck of cards comprises 36 standard playing cards, the 36 cards are in groups as follows: 1 "two", 2 "threes, 3 "fours", 4 "fives", 5 "sixes", 6 "sevens", 5 "eights", 4 "nines", 3 "tens", 2 "Aces" and 1 "Face card", each of the cards having an assigned point values as shown on the card with each "Ace" having a point value of eleven and each "Face Card" having a point value of twelve, each of the point values providing a point for the craps game.

(8) In still another variant, each of the point value selectors is returned to the initial state after yielding a point for the craps game.

(9) In yet another variant, the card drawn from the special deck is returned to the special deck and the deck is either reshuffled or replaced with a reshuffled deck after yielding a point for the craps game.

(10) (Hard Way) In yet a further variant, each group of cards having an even numbered point value includes only one card of a predetermined suit. When a card of a particular point value is drawn and the card is of the predetermined suit, the point value is considered to be drawn "the hard way" resulting in a higher payoff for the bet.

(11) (Pass Line) In still a further variant, a player drawing either of a seven and an eleven prior to any other point will win the bet. A player drawing either a two, a three or a twelve prior to any other point will lose the bet. A player drawing either a four, a five, a six, an eight, a nine or a ten prior to any other point will establish that point as a target. A player drawing the target prior to drawing a seven will win the bet. A player drawing a seven prior to drawing the target will lose the bet.

(12) (Don't Pass Line) In another variant of the invention, a player drawing either a seven or an eleven prior to any other point will lose the bet. A player drawing either a two or a three prior to any other point will win the bet. A player drawing a twelve will draw again. A player drawing either a four, a five, a six, an eight, a nine or a ten prior to any other point will establish that point as a target. A player drawing the target prior to drawing a seven will win the bet. A player drawing a seven prior to drawing the target will lose the bet.

(13) (Come Bet) In still another variant, a player drawing either a seven or an eleven prior to any other point will win the bet. A player drawing either a two, a three or a twelve prior to any other point will lose the bet. A player drawing either a four, a five, a six, an eight, a nine or a ten prior to any other point will establish that point as a target. A player drawing the target prior to drawing a seven will win the bet. After establishment of the target the player places a second bet. A player drawing either a seven or an eleven prior to any other point will win the second bet. A player drawing either a two, a three or a twelve prior to any other point will lose the second bet. A player drawing either a four, a five, a six, an eight, a nine or a ten prior to any other point will establish that point as a come point. A player drawing the come point prior to drawing a seven will win the second bet. A player drawing a seven prior to drawing the come point will lose the second bet.

(14) (Don't Come Bet) In yet another variant of the invention, a player drawing either a seven or an eleven prior to any other point will win the bet. A player drawing either a two, a three or a twelve prior to any other point will lose the bet. A player drawing either a four, a five, a six, an eight, a nine or a ten prior to any other point will establish that point as a target. A player drawing the target prior to drawing a seven will win the bet. After establishment of the target the player places a second bet. A player drawing either a seven or an eleven prior to any other point will lose the second bet. A player drawing either a two or a three prior to any other point will win the second bet. A player drawing a twelve will draw again. A player drawing either a four, a five, a six, an eight, a nine or a ten prior to any other point will establish that point as a come point. A player drawing the come point prior to drawing a seven will lose the second bet. A player drawing a seven prior to drawing the come point will win the second bet.

(15) (Odds) In still another variant, after establishment of either a target or a come point a player places a third bet based upon the point value of a next draw. The third bet is based upon either a success or a failure in drawing either of the target and the come point before a seven is drawn. The third bet pays two to one if either a four or a ten is drawn, pays three to two if either a five, a seven or a nine is drawn and pays six to five if either a six or an eight is drawn.

(16) (Place Bets) In a further variant, after establishment of a target a player places a fourth bet based upon a point value of a next draw. The fourth bet is based upon success in drawing the target before a seven is drawn. The fourth bet pays nine to five if either a four or a ten is drawn, pays seven to five if either a five or a nine is drawn and pays seven to six if either a six or an eight is drawn.

(17) (Field Bets) In still a further variant, prior to any draw, a player places a fifth bet. The fifth bet is based upon the point value of the first card drawn. The fifth bet pays one to one if either a three, a four, a nine, a ten or an eleven is drawn, pays two to one if either a two or a twelve is drawn and loses if either a five, a six, a seven or an eight is drawn.

(18) (Big 6 or 8) In yet a further variant, prior to any draw, a player places a sixth bet. The sixth bet is based upon the point value of any card drawn prior to drawing a seven. The sixth bet pays one to one if either a six or an eight is drawn and pays nothing for any other point value.

(19) (Proposition Bets) In another variant of the invention, prior to any draw, a player places a seventh bet. The seventh bet is based upon the point value of the first card drawn. The seventh bet pays eight to one if either a two, a three, or a twelve is drawn, pays five to one if a seven is drawn and pays fifteen to one if an eleven is drawn.

(20) (Proposition Bets—Hard Way) In another variant, prior to any draw, a player places an eighth bet. The eighth bet is based upon the point value of any card of the predetermined suit drawn prior to drawing a seven. The eighth bet pays eight to one if either a two, a three, or a twelve is drawn and pays fifteen to one if an eleven is drawn.

(41) In still another variant of the invention, a random indicator generator is provided. The random indicator generator is capable of generating only members of a predetermined set of indicators. At least two point value selectors are provided. Each of the set of predetermined indicators designates one of the at least two point value selectors. Each of the point value selectors has an initial state providing all possible point values obtainable from a single roll of a standard pair of dice. Each of the point value selectors yields at least one point for the craps game upon designation by the random indicator generator. A bet is made. The bet depends upon at least one point value selected by at least one of the point value selectors.

(42) In yet another variant, a random indicator generator is provided. The random indicator generator is capable of generating only members of a predetermined set of indicators. At least one point value selector is provided. Each of the set of predetermined indicators designates a predetermined operation of at least one of the point value selectors. Each of the point value selectors has an initial state providing all possible point values obtainable from a single roll of a standard pair of dice. The predetermined operation of each of the point value selectors yields at least one point for the craps game upon designation by the random indicator generator. A bet is made. The bet depends upon at least one point value selected by at least one of the point value selectors.

(43) In still a further variant, the point value selector further comprises a standard deck of cards. Each of the cards has an assigned point value. A top card of the standard deck is drawn to yield a point for the craps game upon designation of the standard deck of cards by the random indicator generator.

(44) In another variant of the invention, the point value selector includes a standard deck of cards. Each of the cards has an assigned point value. A card of the standard deck is drawn based upon the predetermined operation to yield a point for the craps game upon designation of the predetermined operation by the random indicator generator.

(45) In still another variant, each of the point value selectors is returned to the initial state after yielding a point for the craps game upon designation of the point value selector by the random indicator generator.

(46) In a yet another variant, the card drawn from the standard deck is returned to the standard deck and the deck is either reshuffled or replaced with a reshuffled deck after yielding a point for the craps game.

(47) In a final variant of the invention, the random indicator generator is a choice made by a player of the craps game.

It is noted that, while bets are referred to as "second bet", "fourth bet" or "eighth bet", these are merely different types of bets and are not necessarily made in sequential order. For example, a player could make only the "sixth bet" and no others.

An appreciation of the other aims and objectives of the present invention and an understanding of it may be achieved by referring to the accompanying drawings and the detailed description of a preferred embodiment.

DESCRIPTION OF THE DRAWINGS

FIG. 1 is a perspective view of a random indicator selector employing a single dice with integers;

FIG. 2 is a perspective view of a random indicator selector employing a pair of dice with integers;

FIG. 3 is a perspective view of a random indicator selector employing a single dice with geometric designs;

FIG. 4 is a perspective view of a random indicator selector employing a pair of dice with geometric designs;

FIG. 5 is a plan view of a random indicator selector employing a deck of cards and a layout grid;

FIG. 6 is a side elevational view of a random indicator selector employing numbered balls and a ball dispenser.

DETAILED DESCRIPTION OF THE PREFERRED EMBODIMENT (1) FIGS. 1-7 illustrate a variable point generation craps game 10 that may be constructed from the following components. A random indicator generator 15 is provided. The random indicator generator 15 is capable of generating only members 20 of a predetermined set of indicators 25. At least two point value selectors 30 are provided. Each of the set of predetermined indicators 25 designates one of the at least two point value selectors 30. Each of the point value selectors 30 has an initial state 35 providing all possible point values not shown obtainable from a single roll of a standard pair of dice not shown. The point values are available from the point value selector 30 with the same probability as from the standard pair of dice. Each of the point value selectors 30 yields at least one point for the craps game 10 upon designation by the random indicator generator 15. A bet 50 is made. The bet 50 depends upon at least one point value selected by at least one of the point value selectors 30.

Figure 7:
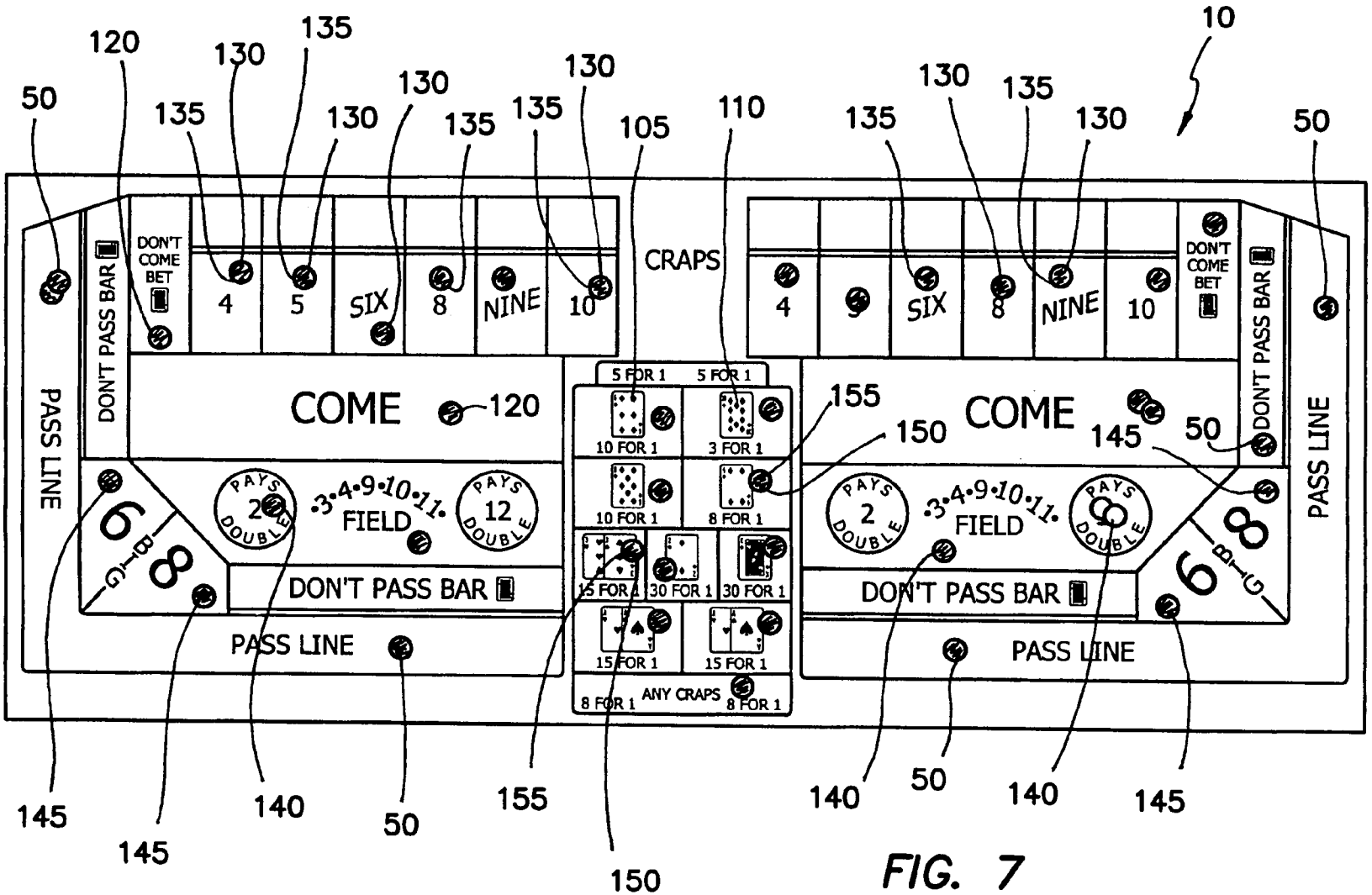
FIG. 7 is a plan view of a craps game playing surface adapted to the present invention.

(2) In a variant of the invention, a random indicator generator 15 is provided. The random indicator generator 15 is capable of generating only members 20 of a predetermined set of indicators 25. At least one point value selector 30 is provided. Each of the set of predetermined indicators 25 designates a predetermined operation not shown of at least one of the point value selectors 30. Each of the point value selectors 30 has an initial state 35 providing all possible point values obtainable from a single roll of a standard pair of dice. The point values are available from the point value selector 30 with the same probability as from the standard pair of dice. The predetermined operation of each of the point value selectors 30 yields at least one point for the craps game 10 upon designation by the random indicator generator 15. A bet 50 is made. The bet 50 depends upon at least one point value selected by at least one of the point value selectors 30.

(3) In another variant, the random indicator generator 15 further comprises at least one special die 60.

(4) In still another variant, the random indicator generator 15 further comprises a special pair of dice 65.

(5) In yet another variant of the invention, the point value selector 30 further comprises a special deck not shown of cards not shown. Each of the cards 75 has an assigned point value. A top card of the special deck is drawn to yield a point for the craps game 10 upon designation of the special deck of cards by the random indicator generator 15.

(6) In yet a further variant, the point value selector 30 further comprises a special deck of cards. Each of the cards has an assigned point value 40. A card of the special deck is drawn based upon the predetermined operation to yield a point for the craps game 10 upon designation of the predetermined operation by the random indicator generator 15.

(7) In another variant of the invention, the special deck of cards comprises 36 standard playing cards not shown, the 36 cards are in groups as follows: 1 "two", 2 "threes, 3 "fours", 4 "fives", 5 "sixes", 6 "sevens", 5 "eights", 4 "nines", 3 "tens", 2 "Aces" and 1 "Face Card", each of the cards having an assigned point values as shown on the card with each "Ace" having a point value of eleven and each "Face Card" having a point value of twelve, each of the point values providing a point for the craps game 10.

(8) In still another variant, each of the point value selectors 30 is returned to the initial state 35 after yielding a point for the craps game 10.

(9) In yet another variant, the card drawn from the special deck is returned to the special deck and the deck is either reshuffled or replaced with a reshuffled deck after yielding a point for the craps game 10.

(10) (Hard Way) In yet a further variant as illustrated in FIG. 7, each group not shown of cards having an even numbered point value 105 includes only one card of a predetermined suit 110. When a card of a particular point value is drawn and the card is of the predetermined suit, the point value is considered to be drawn "the hard way" resulting in a higher payoff for the bet 50.

(11) (Pass Line) In still a further variant, a player (not shown) drawing either of a seven and an eleven prior to any other point will win the bet 50. A player drawing either a two, a three or a twelve prior to any other point will lose the bet 50. A player drawing either a four, a five, a six, an eight, a nine or a ten prior to any other point 40 will establish that point 40 as a target 115. A player drawing the target 115 prior to drawing a seven will win the bet 50. A player drawing a seven prior to drawing the target 115 will lose the bet 50.

(12) (Don't Pass Line) In another variant of the invention, a player drawing either a seven or an eleven prior to any other point will lose the bet 50. A player drawing either a two or a three prior to any other point will win the bet 50. A player drawing a twelve will draw again. A player drawing either a four, a five, a six, an eight, a nine or a ten prior to any other point will establish that point as a target not shown. A player drawing the target prior to drawing a seven will win the bet 50. A player drawing a seven prior to drawing the target will lose the bet 50.

(13) (Come Bet) In still another variant, a player drawing either a seven or an eleven prior to any other point will win the bet 50. A player drawing either a two, a three or a twelve prior to any other point will lose the bet 50. A player drawing either a four, a five, a six, an eight, a nine or a ten prior to any other point will establish that point as a target. A player drawing the target prior to drawing a seven will win the bet 50. After establishment of the target the player places a second bet 120. A player drawing either a seven or an eleven prior to any other point will win the second bet 120. A player drawing either a two, a three or a twelve prior to any other point will lose the second bet 120. A player drawing either a four, a five, a six, an eight, a nine or a ten prior to any other point will establish that point as a come point not shown. A player drawing the come point prior to drawing a seven will win the second bet 120. A player drawing a seven prior to drawing the come point will lose the second bet 120.

(14) (Don't Come Bet) In yet another variant of the invention, a player drawing either a seven or an eleven prior to any other point will win the bet 50. A player drawing either a two, a three or a twelve prior to any other point will lose the bet 50. A player drawing either a four, a five, a six, an eight, a nine or a ten prior to any other point will establish that point as a target. A player drawing the target prior to drawing a seven will win the bet 50. After establishment of the target the player places a second bet 120. A player drawing either a seven or an eleven prior to any other point will lose the second bet 120. A player drawing either a two or a three prior to any other point will win the second bet 120. A player drawing a twelve will draw again. A player drawing either a four, a five, a six, an eight, a nine or a ten prior to any other point will establish that point as a come point. A player drawing the come point 125 prior to drawing a seven will lose the second bet 120. A player drawing a seven prior to drawing the come point will win the second bet 120.

(15) (Odds) In still another variant, after establishment of either a target or a come point a player places a third bet 130 based upon the point value 40 of a next draw. The third bet 130 is based upon either a success or a failure in drawing either of the target 115 or the come point 125 before a seven is drawn. The third bet 130 pays two to one if either a four or a ten is drawn, pays three to two if either a five, a seven or a nine is drawn and pays six to five if either a six or an eight is drawn.

(16) (Place Bets) In a further variant, after establishment of a target a player places a fourth bet 135 based upon a point value of a next draw. The fourth bet 135 is based upon success in drawing the target before a seven is drawn. The fourth bet 135 pays nine to five if either a four or a ten is drawn, pays seven to five if either a five or a nine is drawn and pays seven to six if either a six or an eight is drawn.

(17) (Field Bets) In still a further variant, prior to any draw, a player places a fifth bet 140. The fifth bet 140 is based upon the point value of the first card drawn. The fifth bet 140 pays one to one if either a three, a four, a nine, a ten or an eleven is drawn, pays two to one if either a two or a twelve is drawn and loses if either a five, a six, a seven or an eight is drawn.

(18) (Big 6 or 8) In yet a further variant, prior to any draw, a player places a sixth bet 145. The sixth bet 145 is based upon the point value of any card drawn prior to drawing a seven. The sixth bet pays one to one if either a six or an eight is drawn and pays nothing for any other point value.

(19) (Proposition Bets) In another variant of the invention, prior to any draw, a player places a seventh bet 150. The seventh bet 150 is based upon the point value of the first card drawn. The seventh bet 150 pays eight to one if either a two, a three, or a twelve is drawn, pays five to one if a seven is drawn and pays fifteen to one if an eleven is drawn.

(20) (Proposition Bets—Hard Way) In a final variant, prior to any draw, a player places an eighth bet 155. The eighth bet 155 is based upon the point value of any card of the predetermined suit 110 drawn prior to drawing a seven. The eighth bet 155 pays eight to one if either a two, a three, or a twelve is drawn and pays fifteen to one if an eleven is drawn.

(41) In still another variant of the invention, a random indicator generator 15 is provided. The random indicator generator 15 is capable of generating only members 20 of a predetermined set of indicators 25. At least two point value selectors 30 are provided. Each member 20 of the predetermined set of indicators 25 designates one of the at least two point value selectors 30. Each of the point value selectors 30 has an initial state 35 providing all possible point values obtainable from a single roll of a standard pair of dice. Each of the point value selectors 30 yields at least one point for the craps game 10 upon designation by the random indicator generator 15. A bet 50 is made. The bet 50 depends upon at least one point value selected by at least one of the point value selectors 30.

(42) In yet another variant, a random indicator generator 15 is provided. The random indicator generator 15 is capable of generating only members 20 of a predetermined set of indicators 25. At least one point value selector 30 is provided. Each member 20 of the predetermined set of indicators 25 designates a predetermined operation of at least one of the point value selectors 30. Each of the point value selectors 30 has an initial state 35 providing all possible point values obtainable from a single roll of a standard pair of dice. The predetermined operation of each of the point value selectors 30 yields at least one point for the craps game 10 upon designation by the random indicator generator 15. A bet 50 is made. The bet 50 depends upon at least one point value selected by at least one of the point value selectors 30.

(43) In still a further variant, the point value selector 30 further comprises a standard deck not shown of cards not shown. Each of the cards has an assigned point value. A top card not shown of the standard deck is drawn to yield a point for the craps game 10 upon designation of the standard deck of cards by the random indicator generator 15.

(44) In another variant of the invention, the point value selector 30 includes a standard deck of cards. Each of the cards has an assigned point value. A card of the standard deck is drawn based upon the predetermined operation to yield a point for the craps game 10 upon designation of the predetermined operation by the random indicator generator 15.

(45) In still another variant, each of the point value selectors 30 is returned to the initial state 35 after yielding a point for the craps game 10 upon designation of the point value selector 30 by the random indicator generator 15.

(46) In a final variant of the invention, the card drawn from the standard deck is returned to the standard deck and the deck is either reshuffled or replaced with a reshuffled deck after yielding a point for the craps game 10.

(47) In a final variant of the invention the random indicator generator 15 is a choice made by a player of the craps game 10.

The variable point generation craps game 10 has been described with reference to particular embodiments. Other modifications and enhancements can be made without departing from the spirit and scope of the claims that follow.

The invention claimed is:

1. A variable point generation craps game, comprising:

a random indicator generator, said random indicator being capable of generating only members of a predetermined set of card indicators; wherein said special deck of card comprises 36 standard playing cards, said 36 cards being in groups as follows: 1 "two" of diamonds; 2 "threes" one heart, one spade; 3 "fours" one diamond, one club, one heart; 4 "fives" two hearts, one spade, one club; 5 "sixes" one diamond, one spade, one club, two hearts; 6 "sevens" two hearts, two clubs, two spades, 5 "eights" one diamond, one club, one spade, two hearts; 4 "nines" one spade, one club, two hearts, 3 "tens" one diamond, one heart, one spade; 2 Aces, one heart, one spade; 1 Face Card of diamonds, each of said cards having an assigned point values as shown on said card with each "Ace" having a point value of eleven and each "Face Card" having a point value of twelve, each of said point values providing a point for said craps game; at least one point value selector; each of said set of predetermined card indicators designating a predetermined operation of at least one of said point value selectors, each of said point value selectors has an initial state providing all possible point values obtainable from a single roll of a standard pair of dice, said point values being available from said point value selector with the same probability as from said standard pair of dice; said predetermined operation of each of said point value selectors yielding at least one point for said craps game upon designation by said random indicator generator; and a bet, said bet depending upon at least one card point value by at least one of said point value selectors.

2. The variable point generation craps game, as described in claim 1, wherein said random indicator generator further comprises at least one special die.

3. The variable point generation craps game, as described in claim 1, wherein said random indicator generator further comprises a special pair of dice.

4. The variable point generation craps game, as described in claim 1, wherein each of said point value selectors is returned to said initial state after yielding a point for said craps game upon designation of said point value selector by said random indicator generator.

5. The variable point generation craps game, as described in claim 1, wherein said a random indicator generator is a choice made by a player of said craps game.

6. A variable point generation craps game, comprising: a random indicator generator, said random indicator generator being capable of generating only members of a predetermined set of card indicators; wherein said special deck of card comprises 36 standard playing cards, said 36 cards being in groups as follows: 1 "two" of diamonds; 2 "threes" one heart, one spade; 3 "fours" one diamond, one club, one heart; 4 "fives" two hearts, one spade, one club; 5 "sixes" one diamond, one spade, one club, two hearts; 6 "sevens" two hearts, two clubs, two spades, 5 "eights" one diamond, one club, one spade, two hearts; 4 "nines" one spade, one club, two hearts, 3 "tens" one diamond, one heart, one spade; 2 Aces, one heart, one spade; 1 Face Card of diamonds, each of said cards having an assigned point values as shown on said card with each "Ace" having a point value of eleven and each "Face Card" having a point value of twelve, each of said point values providing a point for said craps game; at least one point value selector; each of said set of predetermined card indicators designating a predetermined operation of at least one of said point value selectors, each of said point value selectors has an initial state providing all possible point values obtainable from a single roll of a standard pair of dice; said predetermined operation of each of said point value selectors yielding at least one point for said craps game upon designation by said random indicator generator; and a bet, said bet depending upon at least one card point value selected by at least one of said point value selectors.

7. The variable point generation craps game, as described in claim 6, wherein each of said point value selectors is returned to said initial state after yielding a point for said craps game upon designation of said point value selector by said random indicator generator.

* * * * *